US007296402B1

(12) United States Patent
Cook

(10) Patent No.: US 7,296,402 B1
(45) Date of Patent: Nov. 20, 2007

(54) DIESEL PARTICULATE FILTER SERVICE METHOD

(75) Inventor: Anthony J. Cook, Fort Wayne, IN (US)

(73) Assignee: International Truck Intellectual Property Company, LLC, Warrenville, IL (US)

( * ) Notice: Subject to any disclaimer, the term of this patent is extended or adjusted under 35 U.S.C. 154(b) by 0 days.

(21) Appl. No.: 11/382,103

(22) Filed: May 8, 2006

(51) Int. Cl.
*F01N 3/00* (2006.01)

(52) U.S. Cl. ..... 60/295; 60/274; 60/296; 60/297; 60/307; 60/311; 95/277; 95/278; 95/279; 55/283; 55/287; 55/302; 96/229; 96/241

(58) Field of Classification Search ..... 60/274, 60/281, 295, 296, 297, 307, 311, 317; 95/277, 95/278, 279, 280; 55/282.2, 282.3, 283, 55/287, 288, 294, 302; 96/228, 229, 241, 96/333

See application file for complete search history.

(56) References Cited

U.S. PATENT DOCUMENTS

| | | | | |
|---|---|---|---|---|
| 5,725,618 | A * | 3/1998 | Shimoda et al. | 55/283 |
| 5,853,438 | A * | 12/1998 | Igarashi | 55/302 |
| 5,956,946 | A * | 9/1999 | Yamada | 60/296 |
| 6,240,725 | B1 * | 6/2001 | Scappatura | 60/311 |
| 6,989,045 | B2 * | 1/2006 | Bailey et al. | 95/129 |
| 7,025,811 | B2 * | 4/2006 | Streichsbier et al. | 95/279 |

* cited by examiner

*Primary Examiner*—Binh Q. Tran
(74) *Attorney, Agent, or Firm*—Jeffrey P. Calfa; Gerald W. Askew

(57) ABSTRACT

A diesel particulate filter of a motor vehicle is cleaned of ash, typically using equipment already available in a service shop. The filter apparatus is disconnected from the exhaust system of a motor vehicle. The filter apparatus is reversed and reconnected to the motor vehicle's exhaust system in a configuration opposite to which the filter apparatus was originally connected. The engine is started and allowed to run at a high idle and no load engine speed to blow ash from the diesel particulate filter into the exit tubing. The ash is then collected in an ash collector.

4 Claims, 1 Drawing Sheet

DIESEL PARTICULATE FILTER SERVICE METHOD

BACKGROUND OF THE INVENTION

1. Field of the Invention

The present invention relates to a method for cleaning a diesel particulate filter for a motor vehicle.

2. Description of the Prior Art

Diesel engines are efficient, durable and economical. Diesel exhaust, however, can harm both the environment and people. To reduce this harm governments, such as the United States and the European Union, have proposed stricter diesel exhaust emission regulations. These environmental regulations require diesel engines to nearly meet the same pollution emission standards as gasoline engines.

One part of diesel exhaust includes diesel particulate material. Diesel particulate material is mainly carbon particles or soot. One way to remove soot from diesel exhaust is with diesel traps. The most widely used diesel trap is a diesel particulate filter which nearly completely filters the soot without hindering exhaust flow. As a layer of soot collected on the surfaces of the inlet channels of the filter, the lower permeability of the soot layer causes a pressure drop in the filter and a gradual rise in the back pressure of the filter against the engine. This phenomenon causes the engine to work harder, thus decreasing engine operating efficiency. Eventually, the pressure drop in the filter and decreased engine efficiency becomes unacceptable, and the filter must either be replaced or the accumulated diesel soot must be cleaned out.

The filter is cleaned of accumulated diesel soot by burning-off or oxidation of the diesel soot to carbon dioxide which is known as regeneration. Regeneration of an existing filter is superior to filter replacement, because no interruption for service is necessary.

In addition to capturing carbon soot, the filter also traps ash particles, such as metal oxides, that are carried by the exhaust gas. These particles are not combustible and, therefore, are not removed during regeneration. The filter must therefore be cleaned or discarded when the ash particles in the filter build up to high levels.

Cleaning ash from a diesel particulate filter is not easily accomplished with typical maintenance shop equipment. The use of shop air to blow out the ash particles does not lend itself to containment of the ash particles. The use of a wet/dry vacuum tool has limited effectiveness on smaller and deeply embedded particles. The use of water or solvents can be detrimental to the substrate and/or washcoat.

One method exposes the filter to excessive handling which increases the potential for inadvertent damage to this expensive component. This method also suggests precautionary methods such as paint masks, safety goggles, and gloves prior to servicing a filter due to the potential for exposure to the hazardous ash particles.

To avoid this dangerous mess, specialized filter cleaning equipment has been developed. The equipment, however, is expensive to purchase for the service shop, which would make the cost of cleaning expensive for the motor vehicle owner.

Therefore, it would be advantageous to develop a method to quickly and easily clean the ash particles from the filter. It would be further advantageous to clean the filter without using costly additional equipment.

SUMMARY OF THE INVENTION

According to the invention there is provided an economical way of cleaning the ash from a diesel particulate filter of a motor vehicle, typically using equipment already available in a service shop. The method of the invention disconnects first and second conduits of a filter apparatus's housing from the entrance tubing and exit tubing respectively of a motor vehicle's exhaust system. A diesel particulate filter is within the housing. The filter apparatus is reversed. The first conduit is now reconnected to the exit tubing and the second conduit reconnects to the entrance tubing.

The engine is started and allowed to run at a high idle and no load engine speed. The engine acts like a mass flow generator to blow ash from the diesel particulate filter into the exit tubing. The ash is then collected with an ash collector.

Additional effects, features and advantages will be apparent in the written description that follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
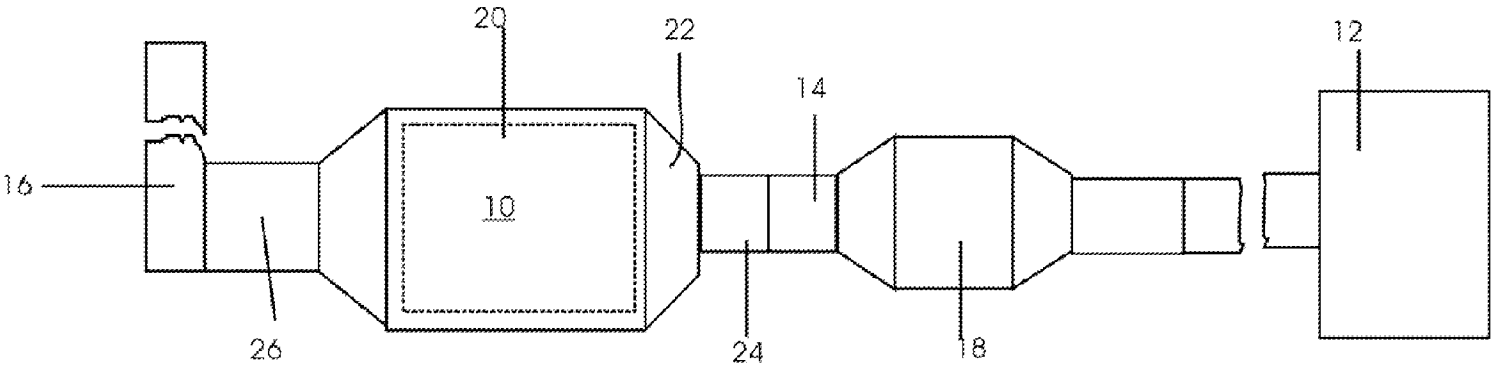
FIG. 1 is a side view of an engine and filter apparatus in the first configuration before cleaning ash with the diesel particulate filter in phantom.

Turning to the Figures where like reference numerals refer to like structures, the present invention relates to a method for cleaning ash from a diesel particulate filter 20 used for treating diesel exhaust gases from a diesel engine 12 in a motor vehicle.

The engine 12 is in fluid communication with the filter apparatus 10 through entrance tubing 14 at the inlet side of the filter apparatus 10. Treated exhaust flows from the filter apparatus 10 through exit tubing 16 at the outlet side of the filter apparatus 10.

As shown in FIG. 1, the filter apparatus 10 has a housing 22 and a diesel particulate filter 20 disposed therein. The filter apparatus 10 may connect with a catalytic device 18 located between the engine 12 and the filter apparatus 10. The housing 22 has a first conduit 24 in fluid communication with the entrance tubing 14. The opposite second conduit 26 is in fluid communication with the exit tubing 16.

To clean the diesel particulate filter 20, the filter apparatus 10 is first removed from the motor vehicle, The second conduit 26 is disconnected from the exit tubing 16, and the first conduit 24 is disconnected from the entrance tubing 14.

Figure 2:
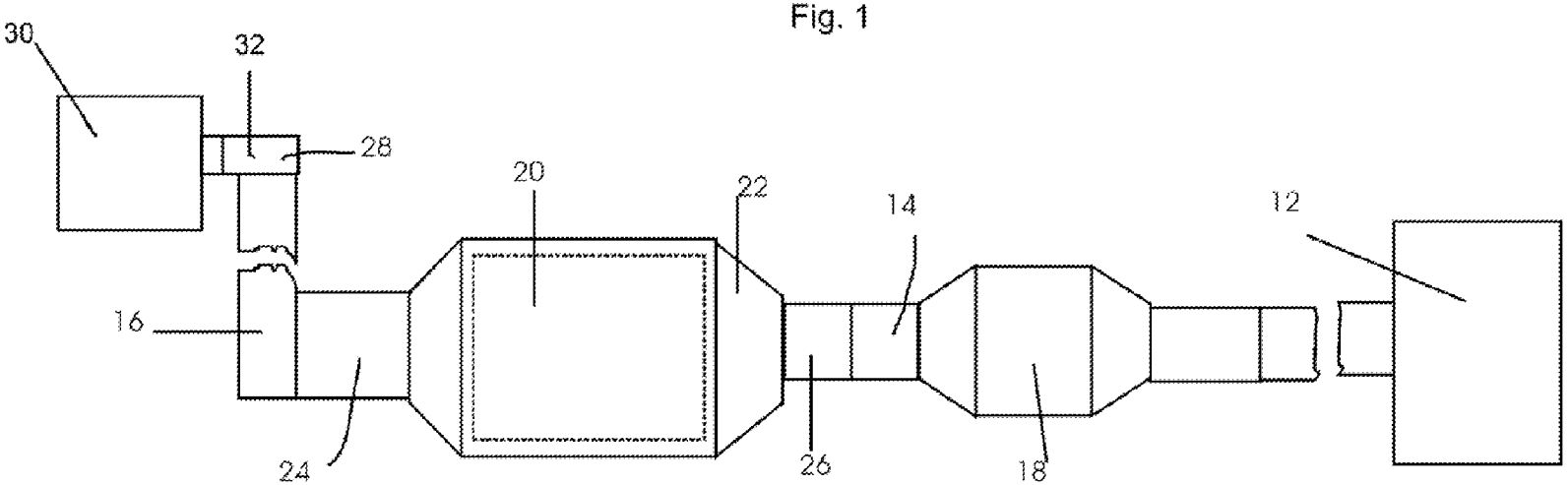
FIG. 2 is a side view of an engine and filter apparatus in the second configuration for cleaning ash with the diesel particulate filter in phantom.

Next, the filter apparatus 10 is reinstalled in the motor vehicle in the opposite direction as shown in FIG. 2. The first conduit 24 connects to the exit tubing 16. The second conduit 26 connects to the entrance tubing 14.

To clean the ash from the diesel particulate filter 20, the engine 12 is started and allowed to increase to a high idle with no load. The engine exhaust produced by the idling engine 12 is filtered by the diesel particulate filter 20. The flow of engine exhaust blows the ash from the diesel particulate filter 20 along with the filtered engine exhaust and into the exit tubing 16 and out of the motor vehicle. The ash is then collected from the exit tubing 16 with an ash collector 32 in fluid communication with the exit tubing 16.

The ash collector 32 can be any type of receptacle, such as a vacuum, or an inline ash filter 28. Preferably the inline ash filter 28 is in fluid communication with the exit tubing 16 and the receptacle or a service shop exhaust system 30. The inline ash filter 28 separates the ash particles from the exhaust gases and traps the ash particles. The separated exhaust gases then flow from the inline ash filter 28 to the shop exhaust system and vent into the environment. Once the ash is removed from the diesel particulate filter 20, the ash collector 32 is removed from the exit tubing 16. The filter apparatus 10 can be disconnected from the entrance tubing 14 and the exit tubing 16 and reconnected in the original filter configuration.

The method of the invention has a number of advantages. The method removes the ash from the diesel particulate filter faster, requiring less preparation. This method also provides an improved way to handle the ash particles. This method uses the motor vehicle's own engine that is being serviced, as well as equipment already available in the service shop. The filter handing requirement for this method is reduced and thus has a lower risk of damage to the filter. Furthermore, the service technicians are less exposed to ash particles.

While the invention is shown in only one of its forms, it is not thus limited but is susceptible to various changes and modifications without departing from the spirit and scope of the invention.

What is claimed is:

1. A method of cleaning ash from a diesel particulate filter for a motor vehicle with an engine, the method comprising the steps of:

providing a filter apparatus comprising a housing having opposite first and second conduits, and a diesel particulate filter being located within the housing;

removing the filter apparatus from the motor vehicle by disconnecting the first conduit of the housing from an entrance tubing in fluid communication with the engine, and disconnecting the second conduit of the housing from an exit tubing in fluid communication with the outside environment;

reinstalling the removed filter apparatus to the motor vehicle in an opposite direction by connecting the first conduit of the housing to the exit tubing and connecting the second conduit of the housing to the entrance tubing;

starting the engine after connecting the first conduit to the exit tubing and the second conduit to the entrance tubing;

increase engine speed to high idle and no load;

allowing engine exhaust to flow from the high idling engine through the entrance tubing into the second conduit and into the housing;

filtering engine exhaust from the idling engine with the diesel particulate filter;

blowing ash from the diesel particulate filter with the filtered engine exhaust through the first conduit of the housing into the exit tubing and out of the motor vehicle; and collecting ash from the exit tubing outside of the motor vehicle with an ash collector in fluid communication with the exit tubing.

2. A method of cleaning ash from a diesel particulate filter for a motor vehicle with an engine of claim 1, wherein ash collector is a receptacle.

3. A method of cleaning ash from a diesel particulate filter for a motor vehicle with an engine of claim 1, wherein the ash collector is an inline ash filter.

4. A method of cleaning ash from a diesel particulate filter for a motor vehicle with an engine of claim 3, the method further comprising the steps of:

separating ash particles in the filtered engine exhaust from exhaust gases with the inline ash filter; and venting the separated exhaust gases from the inline ash filter.

* * * * *